US011719032B2

(12) United States Patent
Zhi et al.

(10) Patent No.: US 11,719,032 B2
(45) Date of Patent: Aug. 8, 2023

(54) DOOR OPENER

(71) Applicant: Guangdong Jusen Hardware Precision Manufacturing Co., Ltd., Foshan (CN)

(72) Inventors: Qi Zhi, Guangdong (CN); Li Shanxiong, Guangdong (CN)

(73) Assignee: Guangdong Jusen Hardware Precision Manufacturing Co., Ltd, Foshan City (CN)

( * ) Notice: Subject to any disclaimer, the term of this patent is extended or adjusted under 35 U.S.C. 154(b) by 6 days.

(21) Appl. No.: 17/291,780

(22) PCT Filed: Dec. 8, 2019

(86) PCT No.: PCT/CN2019/123859
§ 371 (c)(1),
(2) Date: May 6, 2021

(87) PCT Pub. No.: WO2020/134988
PCT Pub. Date: Jul. 2, 2020

(65) Prior Publication Data

US 2022/0025688 A1 Jan. 27, 2022

(30) Foreign Application Priority Data

Dec. 29, 2018 (CN) ..... 201811634024.7

(51) Int. Cl.
*E05F 3/00* (2006.01)
*E05F 1/10* (2006.01)
*E05F 5/02* (2006.01)

(52) U.S. Cl.
CPC ..... *E05F 1/105* (2013.01); *E05F 5/02* (2013.01); *E05Y 2201/224* (2013.01); *E05Y 2201/47* (2013.01); *E05Y 2900/20* (2013.01)

(58) Field of Classification Search
CPC . E05F 1/105; E05F 1/1058; E05F 1/08; E05F 1/10; E05F 1/1025; E05F 1/1041;
(Continued)

(56) References Cited

U.S. PATENT DOCUMENTS 3,376,088 A * 4/1968 Bol ..... E05C 19/165 292/353
6,250,014 B1 * 6/2001 Rusiana ..... E05F 5/12 49/367

(Continued)

FOREIGN PATENT DOCUMENTS

CN 101680260 A 3/2010
CN 102066682 A 5/2011

(Continued)

OTHER PUBLICATIONS

International Search Report for PCT/CN2019/123859, 5 pages.
International Search Report Opinion for PCT/CN2019/123859, 4 pages.

*Primary Examiner* — Chucky Mah
(74) *Attorney, Agent, or Firm* — Boyle Fredrickson, S.C.

(57) ABSTRACT

This invention discloses a door opener, comprising a shell consisting of an upper cover plate (1) and a lower cover plate (2). The key is that a pushing device for pushing the door to rotate is provided in the shell. An end of a driving device, which has one or more springs, can drive, via a rotating member (3), the pushing device to rotate. A locking/releasing device, which cooperates with the driving device, is provided at the other end of the driving device. The structure of this invention is unique. It allows the door to be conveniently opened and will not cause any possible harm to the users.

11 Claims, 5 Drawing Sheets

Figure 1:
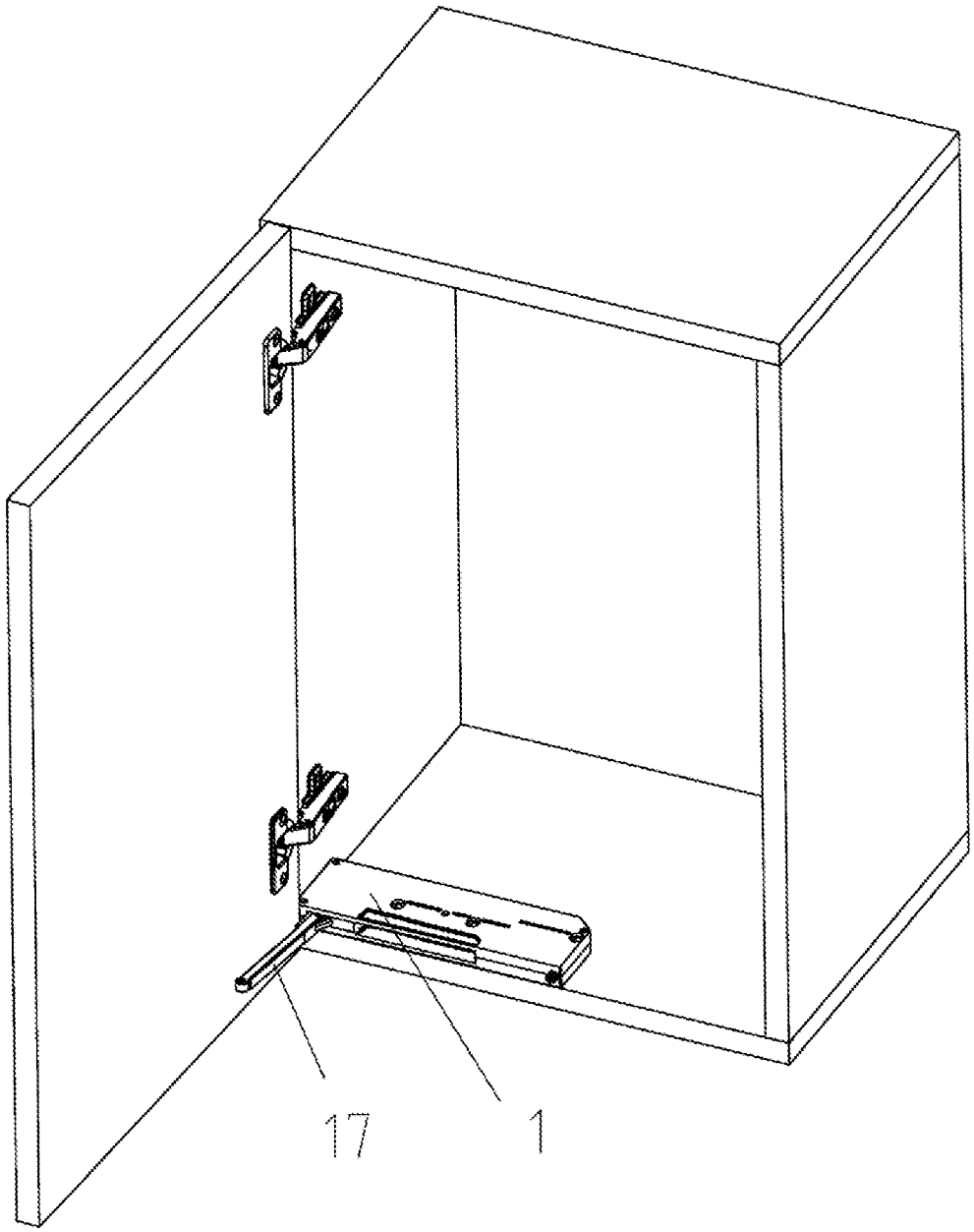

(58) Field of Classification Search
CPC ..... E05F 5/00; E05F 5/02; E05Y 2201/224; E05Y 2201/47; E05Y 2900/20
See application file for complete search history.

(56) References Cited

U.S. PATENT DOCUMENTS

| | | | | |
|---|---|---|---|---|
| 6,910,302 | B2 * | 6/2005 | Crawford | E05F 5/12 49/67 |
| 8,444,237 | B2 * | 5/2013 | Kang | F25D 23/028 312/319.2 |
| 9,995,066 | B1 * | 6/2018 | Ottolini | E05F 15/619 |
| 2011/0131884 | A1 * | 6/2011 | Herper | E05F 1/105 49/386 |
| 2012/0023824 | A1 * | 2/2012 | Mason | E05F 15/622 49/340 |
| 2012/0161598 | A1 * | 6/2012 | Blum | E05F 1/1276 16/280 |
| 2015/0084492 | A1 | 3/2015 | Braungart | |
| 2018/0155972 | A1 * | 6/2018 | Filges | E05F 5/02 |
| 2019/0071908 | A1 * | 3/2019 | Salice | E05D 3/142 |

FOREIGN PATENT DOCUMENTS

| | | | |
|---|---|---|---|
| CN | 102472068 | A | 5/2012 |
| CN | 103015825 | A | 4/2013 |
| CN | 103314172 | A | 9/2013 |
| CN | 103742016 | A | 4/2014 |
| CN | 204081787 | U | 1/2015 |
| CN | 104364456 | A | 2/2015 |
| CN | 204283046 | U | 4/2015 |
| CN | 107849886 | A | 3/2018 |
| CN | 108071727 | A | 5/2018 |
| CN | 109763733 | A | 5/2019 |
| DE | 29907931 | U1 | 9/1999 |
| JP | 2010121359 | A | 6/2010 |

* cited by examiner

DOOR OPENER

CROSS-REFERENCE TO RELATED APPLICATION

This application is a U.S. National Phase under 35 U.S.C. 371 of PCT/CN2019/123859 filed Dec. 8, 2019, and Chinese Patent Application 201811634024.7 filed Dec. 29, 2018 now the entire contents of which are hereby expressly incorporated by reference into the present application.

TECHNICAL FIELD

This invention relates to a hardware fitting for furniture, in particular to an opening or closing device for a furniture door.

BACKGROUND TECHNOLOGY

There are many different kinds of furniture having side opening doors that are necessary for ordinary families. Usually, a side opening door is attached to a cabinet of furniture by a hinge. The user pushes or pulls a handle or a part having a similar function on the door to open or close the door. Children's heads are often hit by the handle. On the other hand, it is still not convenient to pull or push the door for opening or closure. Therefore, it is still a problem to be solved to avoid the drawbacks of the prior art and to provide a side opening door that is more convenient to open or close the furniture.

SUMMARY OF INVENTION

The purpose of this invention is to disclose a device which allows a side opening door to be opened or closed more conveniently.

The technical solution to realize the invention is as follows: The solution comprises a shell consisting of an upper cover plate and a lower cover plate. The key is that a pushing device for pushing the door to rotate is provided in the shell. One end of a driving device, which has one or more springs, drives the pushing device to rotate via a rotating member. At the other end of the driving device, a locking/releasing device that cooperates with the driving device is provided.

The driving device has a sliding sleeve, which can slide on a positioning rod. A first spring is sleeved on the positioning rod. A movable rod is installed inside another through hole of the sliding sleeve. A second spring is provided on the movable rod. A slider connected to an end of the movable rod cooperates with the locking/releasing device to lock and release the driving device. A pulling rod is installed below the sliding sleeve.

The locking/releasing device has a rotatable stopping block, which can block or release the slider. The stopping block is connected with a third spring. The projecting part of the stopping block is engaged with the hook part of a rotatable locking hook. An end of the locking hook is connected to a pushing block, which has a fourth spring, which is a return spring.

The pushing device has a rotatable swinging member, which comprise a swinging rod and a driving lever which cooperates with the pulling rod. The swinging member cooperates with the rotating member.

The swinging device has a concave part, which forms a continuous side surface with a curved surface.

The pushing block has a gap.

The front edge of the slider cooperates with a baffle which is provided at the end of the pulling rod. Another baffle at the other end of the pulling rod cooperates with the driving lever.

The rotating member is fan-shaped, and a roller or roller with bearings is installed at each one of the two angular ends of the rotating member. The end of the swinging rod is provided with a roller.

The exposed end of the pushing block is provided with an adjusting screw. The pushing block is provided with a fifth spring.

One side of the driving device is provided with a damper. The pushing rod of the damper cooperates with a side of a pushing rod.

In actual use, the technical solution of the present invention is integrally installed in a furniture cabinet. When the user presses the side opening door slightly to trigger the releasing device and enable the driving device, which is in the state of energy being pre-stored or the spring inside of which is in the state of being compressed, to move and to drive the pushing device. The pushing device can push the side opening door to a proper open position. Thus, there is no need to install a handle or a similar structure on the side opening door. The side opening door can be closed by pushing the door, and the door is closed under the push of the hinge provided on the side opening door. The above technical solution also has a damper. When the hinge pushes the door to close, the damper slows down the closing speed of the door, avoiding large collision noise or avoiding hitting or crushing the user because of a closing speed that is too fast. The above technical solution has a unique structural design. The door can be opened very conveniently, and will not cause any possible harm to the user.

These, and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

DRAWINGS

FIG. 1, an isometric view of the present inventive door opener installed in a cabinet.

Figure 2:
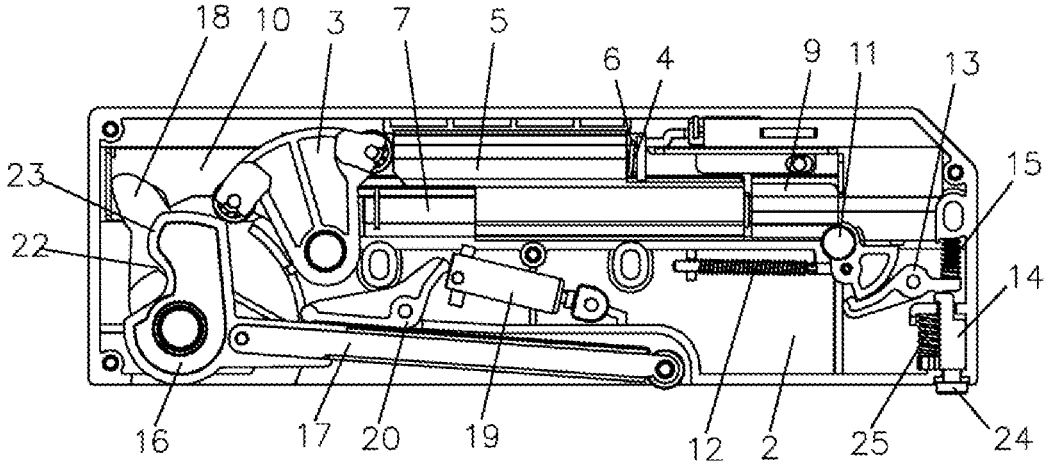

FIG. 2, a front schematic view of an embodiment of the present invention with the door being closed.

Figure 3:
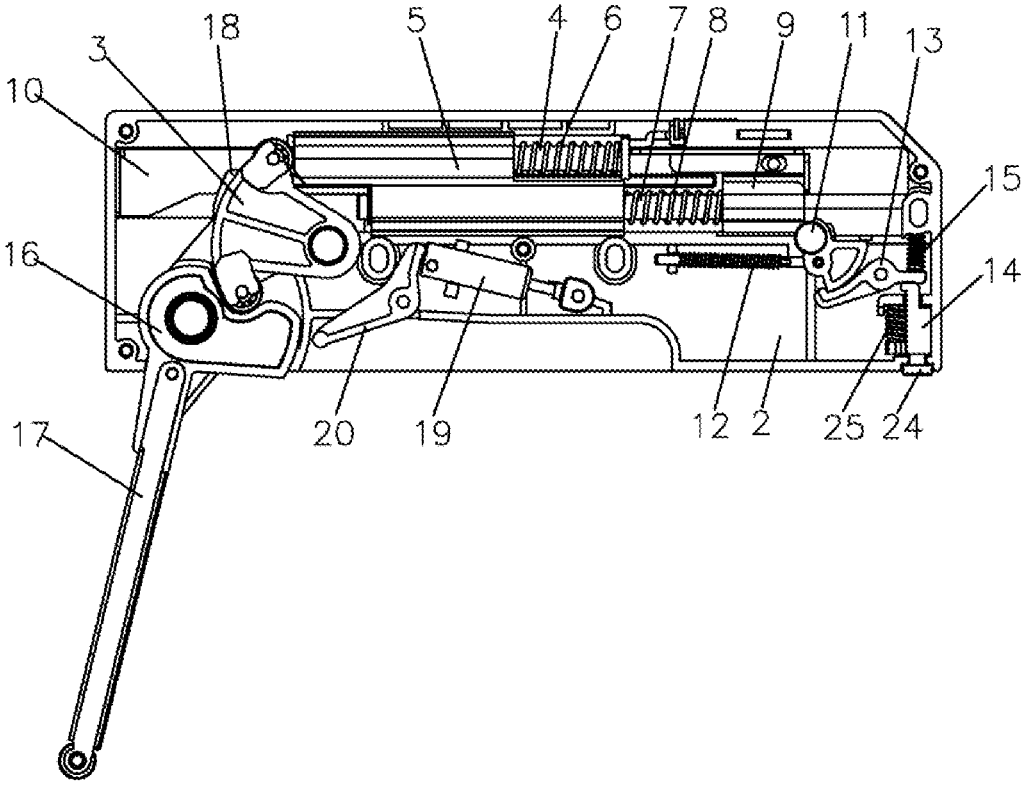

FIG. 3, a front schematic view of an embodiment of the present invention with the door being opened.

Figure 4:
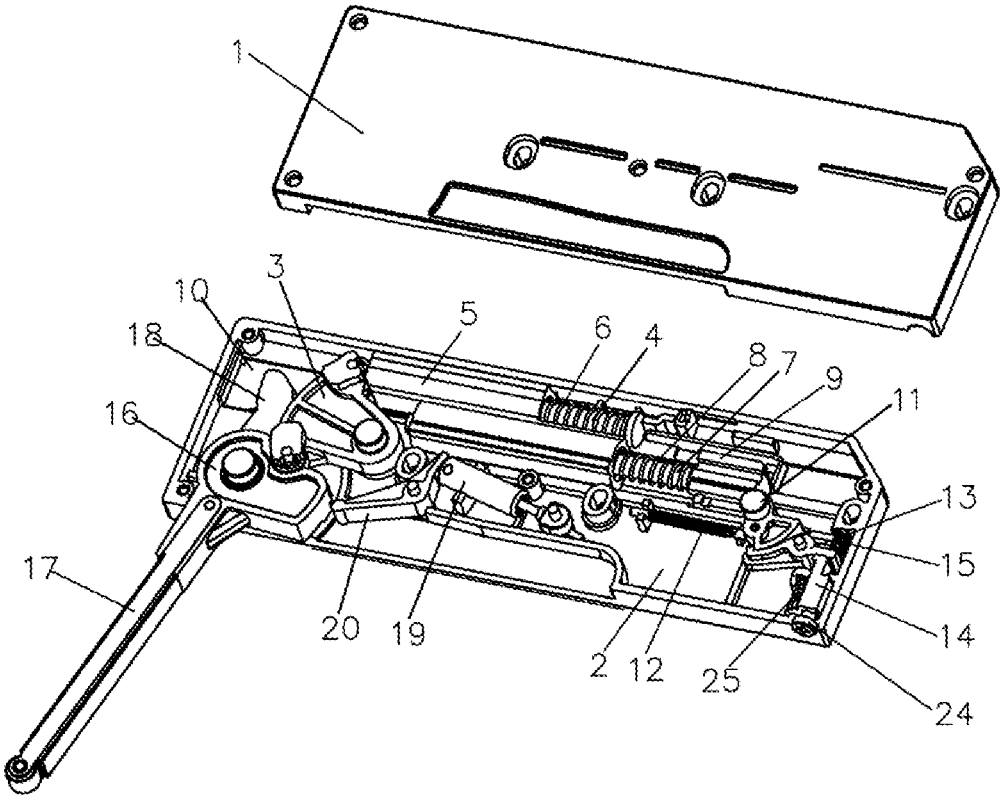

FIG. 4, an isometric view of an embodiment of the present invention with the door being opened.

Figure 5:
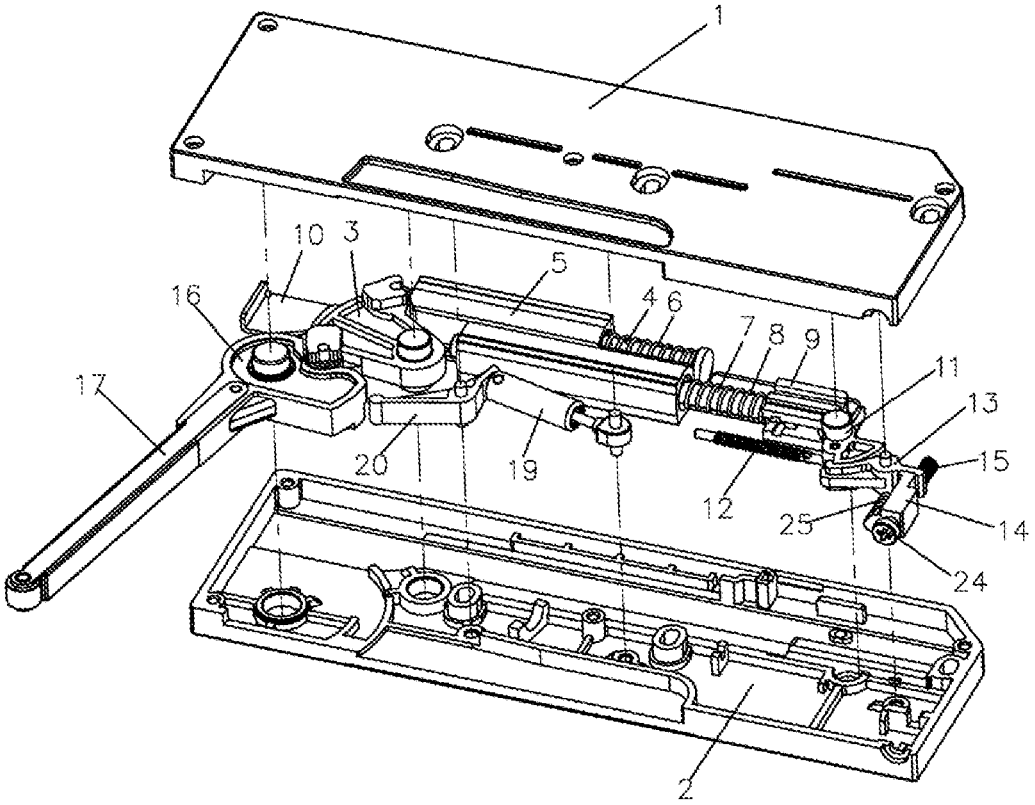

FIG. 5, an exploded isometric view of an embodiment of the present invention with the door being opened.

Figure 6:
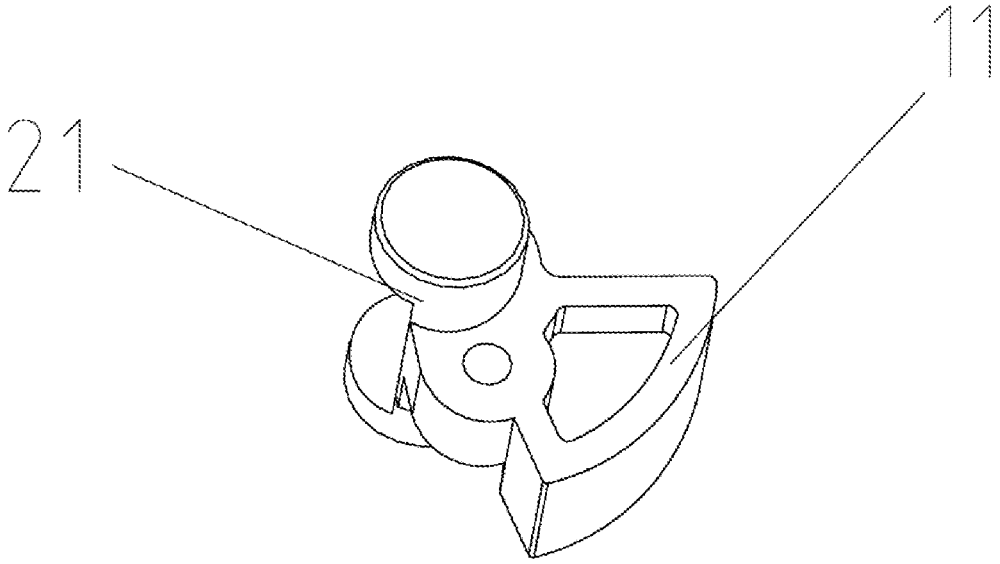

FIG. 6, a isometric view of the block.

Figure 7:
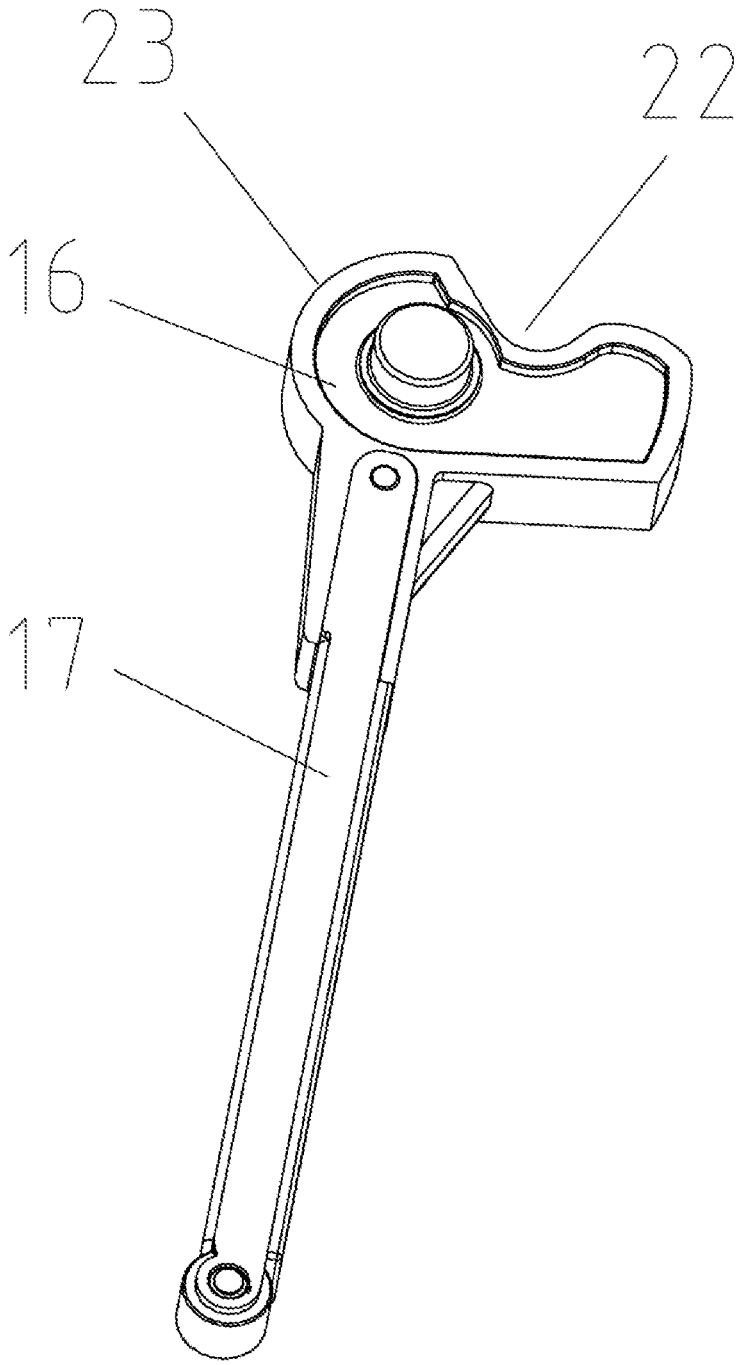

FIG. 7, a isometric view of the swinging member and the swinging rod.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

EMBODIMENTS

A detailed description of specific embodiments of the present invention is provided in combination with the drawings. It needs to be noted that the description of the embodiment is for the comprehensive understanding of the present invention and shall not be considered as a limitation to the claims. Referring to FIGS. 1 to 7, the technical solution of the embodiment of the present invention comprises a shell consisting of an upper cover plate 1 and a lower cover plate 2. The shell is fixed to an appropriate place of the furniture (shown in FIG. 1), so as to realize the opening of a side opening door of the furniture. The key is that a pushing device for pushing the door to rotate is provided in the shell. One end of a driving device, which has springs, can drive, via a rotating member 3, the pushing device to rotate. At the other end of the driving device, a locking/releasing device that cooperates with the driving device is provided. In actual use, the invention is installed at an appropriate place between the cabinet of the furniture and the door (shown in FIG. 1). The user only needs to press the door slightly, and the surface of the door can hit the locking/releasing device, which then releases a locking state of the driving device in a door-closed state. The compressed springs in the driving device move the driving device, thereby moving the pushing device, which pushes the side opening door open. When the door is to be closed, the user pushes the side opening door backwards. The side opening door is closed with the help of the hinge installed on the side opening door, and the invention returns to the door-closed state again (shown in FIG. 2). The present invention greatly facilitates opening and closing of the door by users. There is no need to install a handle on the door body, thereby avoiding possible collision with children and hooking of clothes.

The driving device has a sliding sleeve 5, which can slide on a positioning rod 4, on which a first spring 6 is sleeved. The sliding sleeve 5 slides on the positioning rod 4 under the elastic force of the first spring 6. A movable rod 7 is installed in another through hole of the sliding sleeve 5. A second spring 8 is provided on the movable rod 7. A slider 9 connected to an end of the movable rod 7 cooperates with the locking/releasing device to lock and release the driving device. A pulling rod 10 is installed below the sliding sleeve 5. As shown in FIG. 2, the door opener is in the door-closed state. The first and second springs 6, 8 are both in the state of being compressed and storing energy. The slider 9 is engaged with the locking/releasing device and is in a static state. When the locking/releasing device releases the locking state, the slider 9 moves to the right under the action of the second spring 8, and simultaneously drives the pulling rod 10 to the right, and the other end of the pulling rod 10 pulls the afore-mentioned pushing device to rotate. When the movable rod 7, the slider 9 and the pulling rod 10 have moved to their right end positions respectively, the first spring 6 still in a compressed state drives the sliding sleeve 5 to slide to the left and simultaneously drives the movable rod 7, the slider 9 and the second spring 8 in an unstressed state to the left. When the sliding sleeve 5 moves to the left, an end of the sliding sleeve 5 drives the afore-mentioned rotating member 3 to rotate, which continues driving the pushing device to rotate to open the side opening door to a pre-set position. When the slider 9 moves to the left to a position of the afore-mentioned door-closed state, the locking action of the locking/releasing device is activated, and the slider 9 is again locked from moving to the left. When the side opening door is closed, the slider 9 is in the locking state, and the sliding sleeve 5 is moved to the right, compressing the first and second springs 6, 8 so that the driving device is again in the energy storage state.

The locking/releasing device has a rotatable stopping block 11, which can block or release the slider 9. The stopping block 11 is connected to a third spring 12. The projecting part of the stopping block 11 is engaged with the hook part of a rotatable locking hook 13. An end of the locking hook 13 is connected to a pushing block 14, which has a fourth spring 15, which is a return spring. When this invention is installed at an appropriate position of the furniture, the end of the pushing block 14 can be contacted by the surface of the door. When the user gently presses the door, the door gently presses the pushing block 14, which makes the locking hook 13 to rotate and causes the hook part to be disengaged from the projection of the stopping block 11. Under the action of the compressed second spring 8 and the slider 9, the stopping block 11 rotates and compresses the third spring 12 at the same time. During the driving process of the driving device as described above, when the slider 9 moves to the left and reaches the position before the locking state, the third spring 12 in the compressed state pushes the stopping block 11 to rotate in an opposite direction, enabling the projection part of the stopping block 11 and the hook part of the locking hook 13 to be engaged with each other. The locking state is thus restored and the stopping block 11 prevents the slider 9 from moving.

The pushing device has a rotatable swinging member 16, comprising a swinging rod 17, which is located outside the shell. The swinging member 16 has a driving lever 18 which cooperates with the pulling rod 10. The swinging member 16 cooperates with the rotating member 3. When the driving device works as described above, the slider 9 moves to the right, driving the pulling rod 10 to move to the right too. The other end of the pulling rod 10 pulls the driving lever 18 to move. The driving lever 18 and the rotating member 3 sequentially drive the swinging member 16 to rotate. The swinging rod 17 of the swinging member 16 rotates and pushes the side opening door of the furniture to open. The preceding paragraphs have clearly described the motion and static state of the invention, which perfectly realizes the purpose that the side opening door of the furniture can be opened by gently pressing it.

The swinging member 16 has a concave part 22, which forms a continuous side surface with a curved surface 23 as shown in FIG. 7. During the driving process of the driving device as described above, the first action is for the pulling rod 10 to pull the driving lever 18 to rotate. The rotating member 3 is in a stationary state. The above-mentioned curved surface 23 glides smoothly over an end of the rotating member 3. When the pulling rod 10 stops moving to the right, under the force of the first spring 6, the sliding sleeve 5 moves to the left and pushes the rotating member 3 to rotate. At the same time, the other end of the rotating member 3 moves along the above-mentioned continuous side surface while continuing to drive the rotating member 3 to rotate. At last, one end of the rotating member 3 is engaged with the concave part 22 and makes the swinging rod 17 to reach a maximum swing scale. The structure of the swinging member 16 effectively realizes the successive force from the first and second springs 6, 8, and realizes a continuous and steady rotation.

The above has described the movement state of the drive device and the process of driving the pushing device after the lock is released. One important point is that the stopping block 11 effectively blocks the slider 9 and effectively allows the slider 9 to slide to the right without obstruction. In order to effectively realize the above function, the stopping block 11 has a gap 21 (see FIG. 6), which forms a groove on one side of the stopping block 11. The side part of the slider 9 matches the groove. When in the locked state, the bottom of the groove is at an oblique angle to the horizontal plane. Thus, the bottom of the groove prevents the movement of the slider 9. When in the released state, the convex part of the stopping block 11 and the hook of the locking hook 13 are separated. Then, under the force of the second spring 8, the slider 9 pushes the bottom of the groove of the stopping block 11, driving the stopping block 11 to rotate to a position where the bottom of the groove is in a horizontal state. The slider 9 smoothly moves through the groove. The above structure is very simple, but it plays a key role.

In the driving device, when the locking/releasing device is in the locked state, the front edge of the slider 9 corporates with a baffle at an end of the pulling rod 10. When the locking/releasing device releases the lock, the slider 9 slides to the right, driving the pulling rod 10 to the right. Another baffle at the other end of the pulling rod 10 cooperates with driving lever 18. When the pulling rod 10 moves to the right, the baffle contacts the driving lever 18 and pushes the driving lever 18. The above is only a structure of the pulling rod 10 (see FIG. 4), and a similar structure is not excluded. The function of the rotary member 3 is to transmit the force of the sliding sleeve 5 of the driving device to the rotating member 3. The rotating member 3 is designed in a fan-shape, with two angular ends. An angular end is fitted to the end of the sliding sleeve 5, and the other angular end is fitted to the continuous side surface of the swinging member 16. There is sliding movement between the two angular ends and the sliding sleeve 5 and the swinging member 16 under force. Therefore, in order to reduce the friction and noise during the sliding movement, the two angular ends are provided with rollers or rollers with bearings. The end of the swinging rod 17 is provided with a roller. The above-mentioned rollers can all reduce the friction force and friction noise.

Due to the installation accuracy of the door opener of the present invention and/or the installation accuracy between the cabinet and the door, there may exist a large gap between the exposed end of the pushing block 14 and the side opening door of the furniture. The gap may even affect the effective releasing of the locked state of the locking/releasing device. Therefore, an adjusting screw 24 is arranged at the exposed end of the pushing block 14. If the gap is too large or too small, the screw 24 can be rotated to adjust the size of the gap to avoid the occurrence of unsuccessful releasing or erroneous releasing as a result of a light touch. In order to more effectively reset the pushing block 14, a fifth spring 25 is arranged between the pushing block 14 and the shell.

The above has given the structure and the action process of the technical solution of this invention. After the side opening door is opened, the user pushes the side opening door to close the door. The process of closing the side opening door is: Firstly, the side opening door pushes the swinging rod 17 to rotate the swinging member 16. The swinging member 16 drives the sliding sleeve 5 to move to the right, compressing the first and the second springs 6,8. The sliding sleeve 5 stops sliding when it reaches the end of the positioning rod 4. The first and the second springs 6,8 have finished storing energy. The swinging rod 17 keeps rotating under the action of the hinge on the door. If the hinge itself has a damper, the side opening door can be pushed to the closed state steadily. If the hinge itself does not have a damper, in order to avoid loud closing noise and erroneous triggering of the locking/releasing device as a result of an excessively fast closing speed under the force of the hinge, a damper 19 is arranged at a side of the driving device of the present invention. The piston rod of the damper 19 cooperates with an edge of a rotatable pushing rod 20. When the door is being closed to a certain position, the swinging rod 17 contacts another edge of the pushing rod 20. After the pushing rod 20 rotates, the edge of the pushing rod 20 contacts the piston rod so that the damper 19 functions to avoid the above-mentioned collision noise and erroneous triggering.

The rotating parts mentioned above are all provided with fixing pins to position the rotating parts with the shell. Since these technologies are predictable and are known to those having ordinary skill in the art, this specification does not describe the fixing pins in detail. The technical solution of the present invention is very unique and no similar mechanical structure has been disclosed in the prior art. Of course, similar technologies, which appear following the teaching of the present invention and have the same effect, shall be considered as falling into the protection scope of the present invention.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A door opener for opening a door comprising:

a shell consisting of an upper cover plate and a lower cover plate;

a driving device with a first end and a second end contained within the shell;

at least one spring associated with the first end of the driving device and movable between a compressed state and an unstressed state;

a rotating member associated with the second end of the driving device that is rotated by the driving device when the at least one spring is moved from the compressed state to the unstressed state;

a pushing device contained within the shell configured for pushing the door when the rotating member is rotated by the driving device; and a locking/releasing device provided at the second end of the driving device that is movable between;

a lock position in which movement of the driving device is prevented; and a release position in which movement of the driving device is enabled.

2. The door opener according to claim 1, further comprising:

a sliding sleeve associated with the driving device;

a positioning rod associated with the driving device, wherein the sliding sleeve slides along the positioning rod;

a movable rod installed inside a through hole of the sliding sleeve;

a second spring on the movable rod; and a slider connected to an end of the movable rod that cooperates with the locking/releasing device so as to lock and release the driving device.

3. The door opener according to claim 2, further comprising:

a rotatable stopping block associated with the locking/releasing device, wherein the rotatable stopping block is configured to block or release the slider;

a third spring connected to the rotatable stopping block;

a rotatable locking hook having a first end and a hook part;

a projecting part of the block engaged with the hook part of a rotatable locking hook; and a pushing block connected to the first end of the rotatable locking hook; and a fourth spring connected to the rotatable locking hook, which is a return spring.

4. The door opener according to claim 3, further comprising:

a rotatable swinging member having a swinging rod and a driving lever which cooperates with the swinging rod;

wherein the rotatable swinging member is associated with the pushing device; and wherein the swinging member cooperates with the rotating member.

5. The door opener according to claim 4, wherein the swinging member has a concave part, which forms a continuous side surface with a curved surface.

6. The door opener according to claim 5, wherein the stopping block has a gap formed therein configured to receive a portion of the slider.

7. The door opener according to claim 6, further comprising:

a first baffle provided at an end of the pulling rod;

a front edge of the slider configured to cooperate with the baffle; and a second baffle at the other end of the pulling rod configured to cooperate with the driving lever.

8. The door opener according to claim 7, further comprising a first roller installed at one end of the rotating member and a roller is provided at the end of the swinging rod;

wherein the rotating member is fan-shaped.

9. The door opener according to claim 8, further comprising:

an exposed end of the pushing block;

an adjusting screw provided at the exposed end, and a fifth spring provided with the pushing block.

10. The door opener according to claim 9, further comprising:

a damper extending along one side of the driving device; and wherein a pushing rod of the damper cooperates with a side of the pushing rod.

11. The door opener according to claim 7, further comprising a roller with bearings installed at one end of the rotating member.

* * * * *